US007011269B1

(12) United States Patent
Chouinard et al.

(10) Patent No.: US 7,011,269 B1
(45) Date of Patent: Mar. 14, 2006

(54) FENCING APPARATUS AND METHOD

(76) Inventors: Ronald D. Chouinard, 1228 S. 13th St., Escanaba, MI (US) 49829; Jeffrey J. Lancour, 7822 Tipperary Rd., Gladstone, MI (US) 49837

( * ) Notice: Subject to any disclaimer, the term of this patent is extended or adjusted under 35 U.S.C. 154(b) by 0 days.

(21) Appl. No.: 10/858,481

(22) Filed: Jun. 1, 2004

Related U.S. Application Data

(60) Provisional application No. 60/474,639, filed on May 29, 2003.

(51) Int. Cl.
*B65H 16/02* (2006.01)

(52) U.S. Cl. ..... 242/557; 242/403; 242/594.6; 242/423

(58) Field of Classification Search ..... 242/423, 242/557, 594, 594.6
See application file for complete search history.

(56) References Cited

U.S. PATENT DOCUMENTS

| | | | | |
|---|---|---|---|---|
| 3,749,368 | A * | 7/1973 | Miller | 256/11 |
| 3,934,655 | A * | 1/1976 | Whistle | 173/46 |
| 5,662,313 | A * | 9/1997 | Forrester | 256/11 |
| 6,065,714 | A * | 5/2000 | Fondacaro | 242/557 |
| 6,302,156 | B1 * | 10/2001 | Lardet et al. | 140/16 |

* cited by examiner

*Primary Examiner*—Kathy Matecki
*Assistant Examiner*—Sang Kim
(74) *Attorney, Agent, or Firm*—John R. Benefiel

(57) ABSTRACT

An apparatus and method for fencing in which multiple strands of barbed wire are simultaneously pretensioned and strung along fence post caps by being unwound from a plurality of rolls mounted on a utility vehicle against a retarding force, each strand routed around sets of pulleys in being strung drawn along the fence posts. A walkway platform on the vehicle allows an installer to reach the fence post caps to tie the barbed wire strands to the fence post caps. The post caps are first installed by being dispensed off a rack extending over the walkway together with a tension wire.

19 Claims, 7 Drawing Sheets

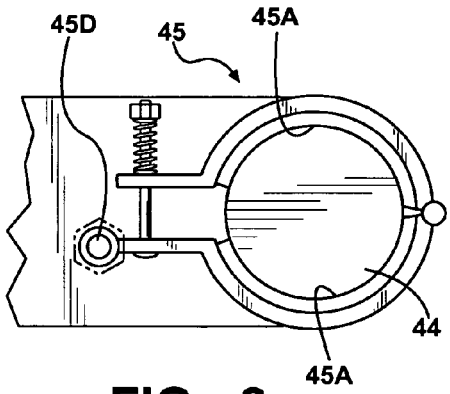
FIG - 8
FIG - 7
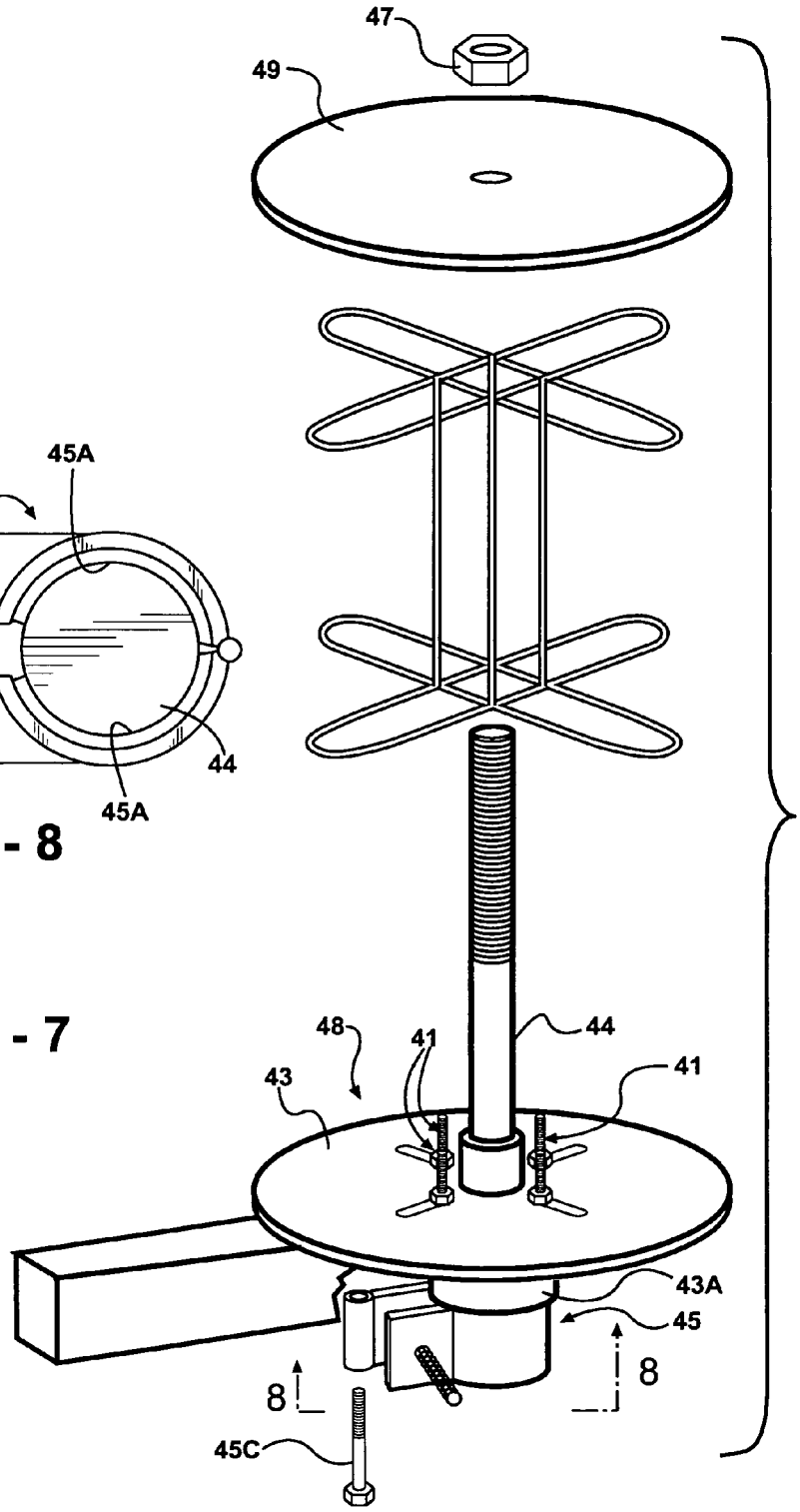

FENCING APPARATUS AND METHOD

CROSS REFERENCE TO RELATED APPLICATION

This application claims the benefit of U.S. provisional Ser. No. 60/474,639, filed May 29, 2003.

BACKGROUND OF THE INVENTION

This invention concerns the erection of fencing of the type including multiple strands of barbed wire strung along the top of fencing fabric secured to line posts. Such fencing typically includes tension wires strung between the posts and anchored to starter and termination posts to stabilize the position of line of posts without using horizontal pipes.

Angled or vertical "barb" caps are first installed on the tops of the posts and then an upper tension wire is strung through openings in the caps, the wire tensioned and then attached to each cap. A lower tension wire is also often strung along the posts, tensioned and anchored, and also attached to the posts with conventional attachments.

Thereafter, the fence fabric is unwound along the posts and attached thereto.

Finally, multiple strands of barb wire are strung along the barb caps, tensioned, and attached thereto.

Particularly for large fencing projects, the need for such time consuming multiple passes along the fence line greatly increases the labor required.

It is the object of the present invention to provide an apparatus and method for reducing the time and labor required to erect such barbed wire topped fences.

SUMMARY OF THE INVENTION

The above object and other objects which will be understood upon a reading of the following specification and claims are achieved by a motor vehicle mounted wire dispenser arrangement including a plurality of reel mounts supported to rotate about a vertical axis, each reel having an adjustable rotation retarding device resisting rotation thereof to a predetermined extent so that pulling a wire strand therefrom generates a predetermined tension in the wire strand as it is unwound. The multiple strands are routed through pulley sets to be substantially aligned with and extending in the direction to be strung along the fence post caps.

Also mounted on the vehicle is a bar rack extending above a walkway mounted on one side of the vehicle. A number of barb caps are stowed side by side on the bar rack which passes through an opening in each barb cap to slidably hold the same. A tension wire is strung through the barb cap, unwound off a reel on the wire dispenser. A second reel of tension wire may also be included on the wire dispenser arrangement and strung along the line posts as the vehicle traverses the post line.

An installer on the walkway places a barb cap on each successive post, sliding each cap off the rack bar. After traversing the fence section, the tension wires, having been anchored at one end to a start post, are tightened as with a fence jack and secured to a termination post. The tension wires are then connected to each post and barb cap.

In a second pass along the fence line, the multiple barbed wire strands are simultaneously strung to the post caps under a predetermined degree of tension. Wound rolls of barbed wire, (typically three in a number) are installed on respectively rotary roll supports. Each barbed wire strand is pulled off a respectively roll by rotation of the associated support and is routed to a first set of side by side pulleys mounted on the one side of the vehicle for rotation about a substantially horizontal aligned axis. The strands are each passed around a respective pulley in the first set, and extend substantially vertically upwardly to and around a second set of pulleys on an upright member, the second set of pulleys also rotatable about a substantially horizontal axis. From there, the multiple strands are routed around a third set of pulleys mounted on a swing arm pivoted to the top of the upright member. The third set of side by side pulleys are each mounted for rotation about an axis parallel to the other pulleys in the set, each axis normal to the swing arm.

The third set pulleys are inclined to approximately match the inclination of the barb arms such that the strands extend in rough alignment with the direction that the strands are to be strung along the barb caps to be easily simultaneously strung under tension along the barb caps as the vehicle traverses the fence line. The strands are tensioned by the preset established by retarders and the resistance generated by passing through each respective pulley in the respective three pulley sets. An installer on the walkway can secure the barbed wire strands in slots in the barb caps in the conventional manner.

The inclination of the swing arm may be adjustably positioned by a power cylinder to compensate for any sloping grade encountered by the vehicle as it traverses the fence line.

The swing arm can be repositioned to allow the swing arm to swing through a vertical range when the barb caps are vertically oriented.

DESCRIPTION OF THE DRAWINGS

FIG. 7 is an exploded pictorial view from above of a rotary roll support included in the fencing apparatus according to the invention.

FIG. 8 is a top view of a friction snubber component shown in FIG. 7.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
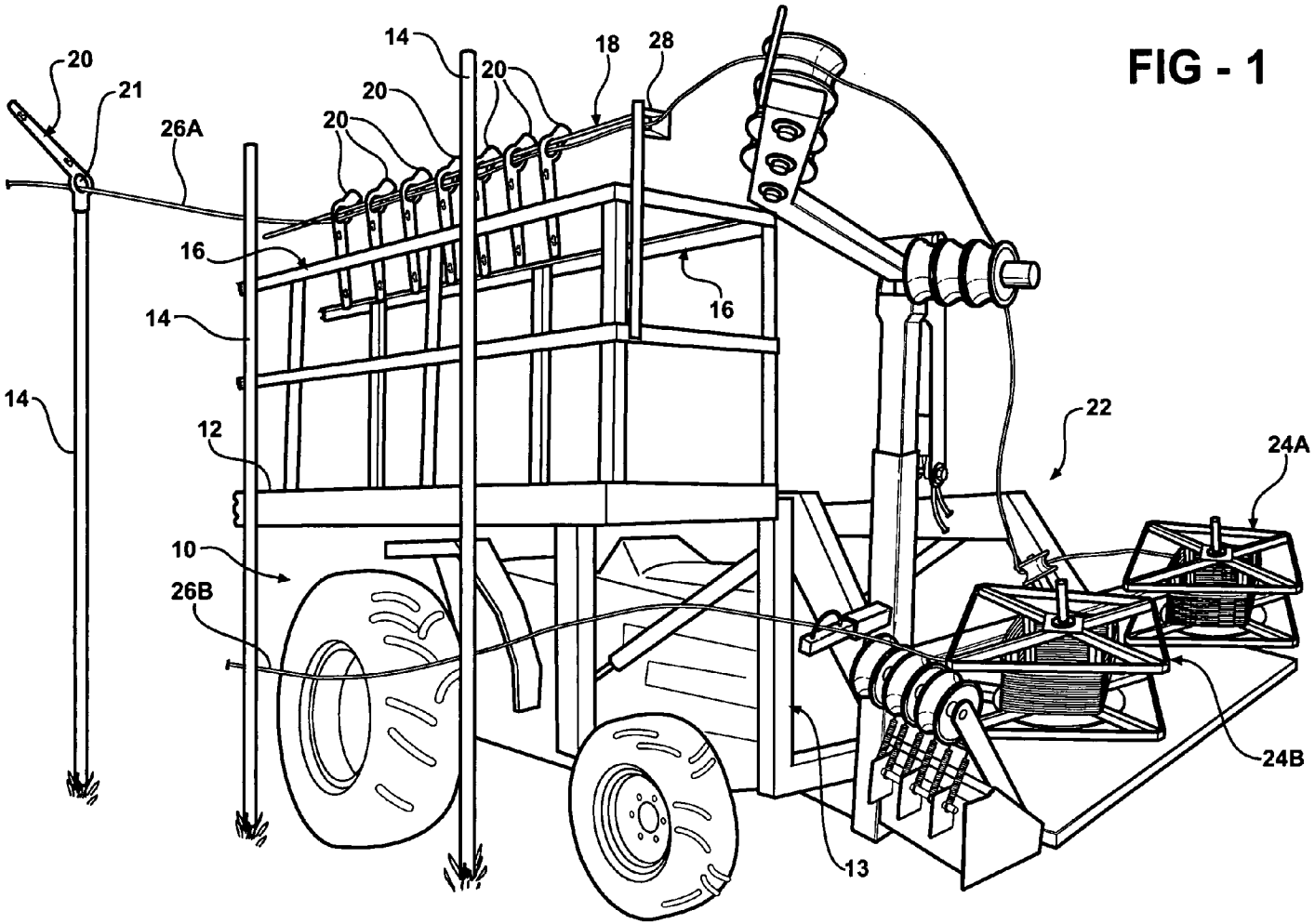
FIG. 1 is a pictorial side view of a vehicle equipped with a fencing apparatus according to the invention with portions of a partially erected fence shown having with tension wires and barb caps in the process of being installed.

Referring to FIG. 1, a utility motor vehicle 10, shown as a tractor equipped with a front end loader 11, has an elevated platform walkway 12 mounted on one side by an under framework 13 attached to the front end loader so as to enable raising the same. The platform walkway 12 is position at a height allowing (an installer) standing thereon to conveniently reach the top of a line of fence posts 14. A safety railing 16 is provided on three sides.

A bar rack 18 is mounted extending above and along the walkway 12, cantilevered from its forward end to allow a series of barb caps 20 to be slid one by one onto the rack 18 which is received in a through opening 19 in each cap 20, and slid one by one off the free end thereof.

A wire dispensing arrangement 22 is mounted at the front end of the under framework 13.

A pair of rolls 24A, 24B of tension wire 26 are loaded therefrom. A first strand of kinked tension wire 26A is guided around a series of pulleys, described below in detail, to a guide 28 at an upper level, and thence through the opening 21 in each barb cap 20.

Since the tension wires 26A, 26B are tensioned after being strung, only a loose guiding thereof is necessary in being strung along the fence posts 14.

The vehicle 10 is driven along the line of fence posts 14, stopping or slowly driving past each post 14, and an installer on the walkway platform 12 places a barb cap 20 on the top of each fence post 14.

The upper and lower tension wire 26A, 26B are at the same time loosely strung along the posts 14, the upper wire 26A passing through the openings 21 in the caps 20.

After the fence section to be erected has been traversed in this manner, each of the tension wires 26A, 26B, having previously been anchored to a starting post (not shown), is stretched to a proper tension, as by use of a fence jack, in the well known manner, and secured to an end post (not shown) secured to the line posts 14 and barb caps 20 in a known manner.

Figure 2:
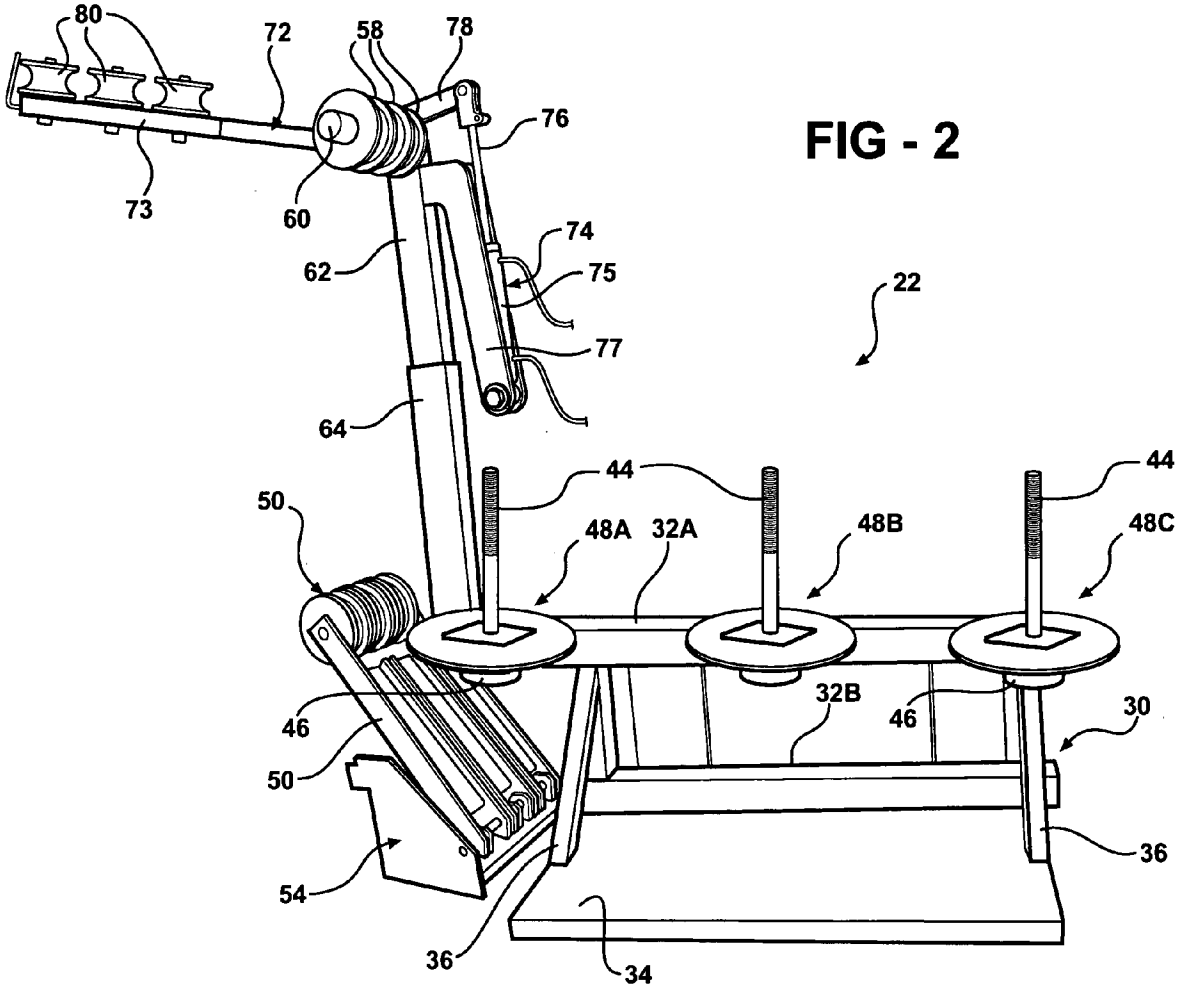
FIG. 2 is a pictorial view from the rear of a wire dispensing arrangement included in the fencing apparatus installed on the vehicle shown in FIG. 1, prior to installation of rolls of wire thereon.
Figure 3:
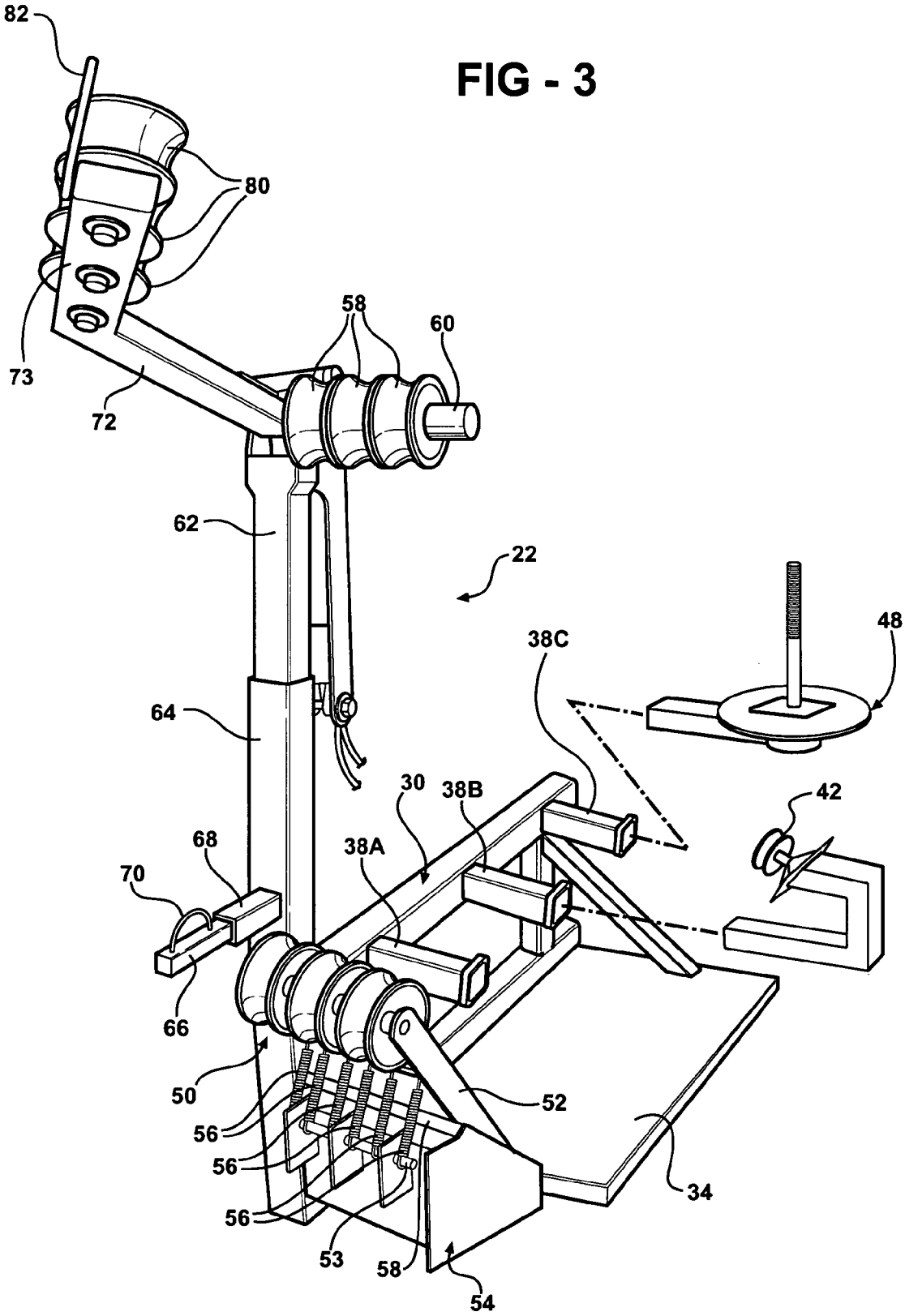
FIG. 3 is a pictorial view from the rear of the wire dispenser arrangement shown in FIG. 2 ready for placing of rolls of reel rotary supports and rolls of wire thereon.

FIGS. 2 and 3 show further details of the wire dispenser arrangement 22 shown in FIG. 1. A wire dispenser support structure 30 is mounted at the front of the under frame 13, including an upper rear cross member 32A of rectangular steel tubing, a lower cross member 32B, also of steel tubing, a bottom plate 34 which can provide wire rolls storage, vertical plate members 35 and side braces 36.

A series of three "trailer hitch" type sockets 38A, B, C are welded to the upper cross member 32A, projecting forwardly therefrom (FIG. 3).

A series of rotary roll supports 48A, B, C may be removably installed in the hitch sockets 38A, B, C. When the tension wire reels 24A, 24B are installed on the two outer rotary supports 40, a guide pulley 42 is installed in the center hitch support 40 (FIGS. 1 and 3).

Referring to FIGS. 7 and 8, each rotary roll support 48A, B, C is a modified version of a commercially available product, and includes an upright spindle shaft 44 threaded on the upper end, rotationally connected to a rotation retarder 45 which resists rotation of the shaft 44 to a preset degree, and a circular platform 43 welded to hub 43A attached to the shaft 44. Such retarder 45 may be a frictional snubber in which friction shoes 45A engage shaft 44 with an adjustable force or alternatively a hydraulic retarder that resists rotation of the spindle shaft 44 such that a predetermined tension can be developed when a wire strand wound thereon is pulled off when being strung. The shaft 44 is rotatably supported on a bar support 47 slidable in one of the hitch sockets 38A–C.

A top disc 49 is placed on each shaft 44, and tightened down on the wire roll with nuts 47, so that a rotation connection to the respective rotary support 48A–C and retarders 45 is established by rotation of the roll rotary support 48A–C about a substantially vertical axis defined by shafts 44, which may tilted from the vertical to some degree depending on the slope the vehicle 10 is negotiating.

A bolt spring with assembly 51 allows adjustment of the snubbing force (FIG. 8).

A series of bolt-nut assemblies 41 project bolt ends up through the support disc 43 and into pocket portions of a wire roll core C on which the barbed wire is wound when purchased from a supplier (FIG. 7). In order to insure a rotary connection to the rotary roll support 48A, B, C. A spring loaded bolt 45B allows adjustment of the friction developed by the shoes 45A. A separate bolt 45C passes through a boss 45D and is seated in the bar 47 to fix the retarders 45 against rotation.

As noted above, the tension wire strands 26A, 26B are not fully tensioned when being strung such that the roll of the retarders 45 is not significant in that context.

Figure 4:
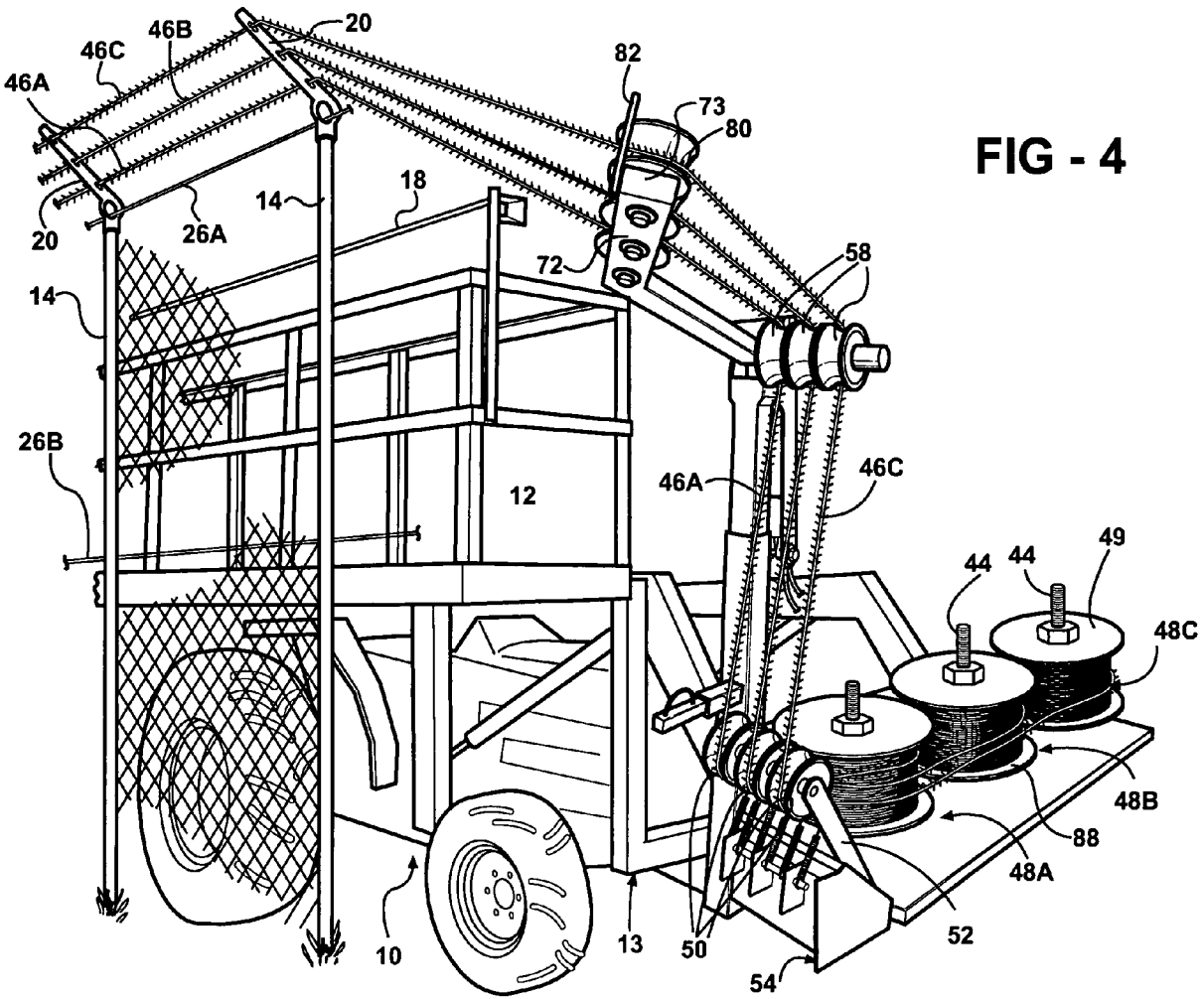
FIG. 4 is a pictorial side view of the apparatus shown in FIG. 1, but in the process of stringing multiple strands of barbed wire on a section of fence.

The barbed wire strands 46A, 46B, 46C must all be fully tensioned when simultaneously strung as indicated in FIG. 4.

In order to fully tension all of the barbed wire strands 46A–C, rotary supports 48A–C are each provided with a separate retarder such that each strand is strung against the resistance of the individual retarder 45. Thus, as the vehicle 10 moves along the fence line, the slightly differing dispensed lengths of the barbed wire strands does not cause one wire to resist movement of the vehicle and the others to become slack. Instead, all of the strands are tensioned independently of the other strands to the same level set by the respective retarder 45.

Three barbed wire rolls are installed on the three rotary roll supports 48A, B, C, an additional rotary support 48B installed on the center hitch socket 38B in this case (FIGS. 1 and 3).

Each rotary roll support 48A–C unspools a respective strand of barbed wire 46A–C from rolls of prewound barbed wires placed on each rotary support 48A–C.

According to the present invention, a series of pulley sets are provided to redirect the unwound barbed wire strands 46A–C to exit in a direction to be roughly aligned with the direction in which they are to be strung when exiting the pulley sets.

The barbed wire strands 46A–C each extend horizontally across the width of the apparatus to the one side of the vehicle to a first set of three pulleys 50 on the one side of the vehicle 10, each pulley 50 supported between a pair of arms 52 pivoted to a fixed bracket 54. Pairs of tension springs 56 are connected to each pair of arms 52 and to a fixed rod 53 to hold the arms 52 in position abutting a fixed plate 58 of the bracket 53. This provides an emergency overload release if the barbed wire strands 46A–C are snagged to be suddenly overloaded to allow a driver time to stop before breaking any of the wire strands.

The pulleys 50 of the first set are arranged side by side and are rotatable about an aligned substantially horizontal axis with a respective barbed wire strand 46A–C passed around a respective one of the pulleys 50 and then upwardly to a second set of pulleys 58 mounted side by side above the first set on a rod 60, to also all be rotatable about a substantially horizontal coaxial axis. The rod 60 projects from an adjustable height member 62 telescoped into a fixed upright tube member 64. A locking bar 66 slidable in a square tube 68 allows height adjustment of the member 62 by being located in a selected one of a series of holes (not shown) in the members 62. A curved rod 70 welded to the bar 66 provides a convenient handle and a guide for one of the tension wires 26B (FIG. 1).

An angled support arm 72 is pivoted on the upper end of the member 62, held in a particular pivoted position by a hydraulic cylinder 74 having an output rod 76 connected to an extension arm 78, the cylinder body 75 pinned to a pair of anchor members 77 fixed to upper member 62.

A third set of pulleys 80 are mounted on the support arm 72 to be rotatable about axes parallel to each other and normal to the arm 72. The angled shape of arm 72 locates the pulleys 80 to be approximately aligned with the second set of pulleys 58. The strands 46A–C exit the third set of pulleys in approximate alignment with the direction they are strung, so that the vehicle motion creates proper tensioning thereof.

Figure 5:
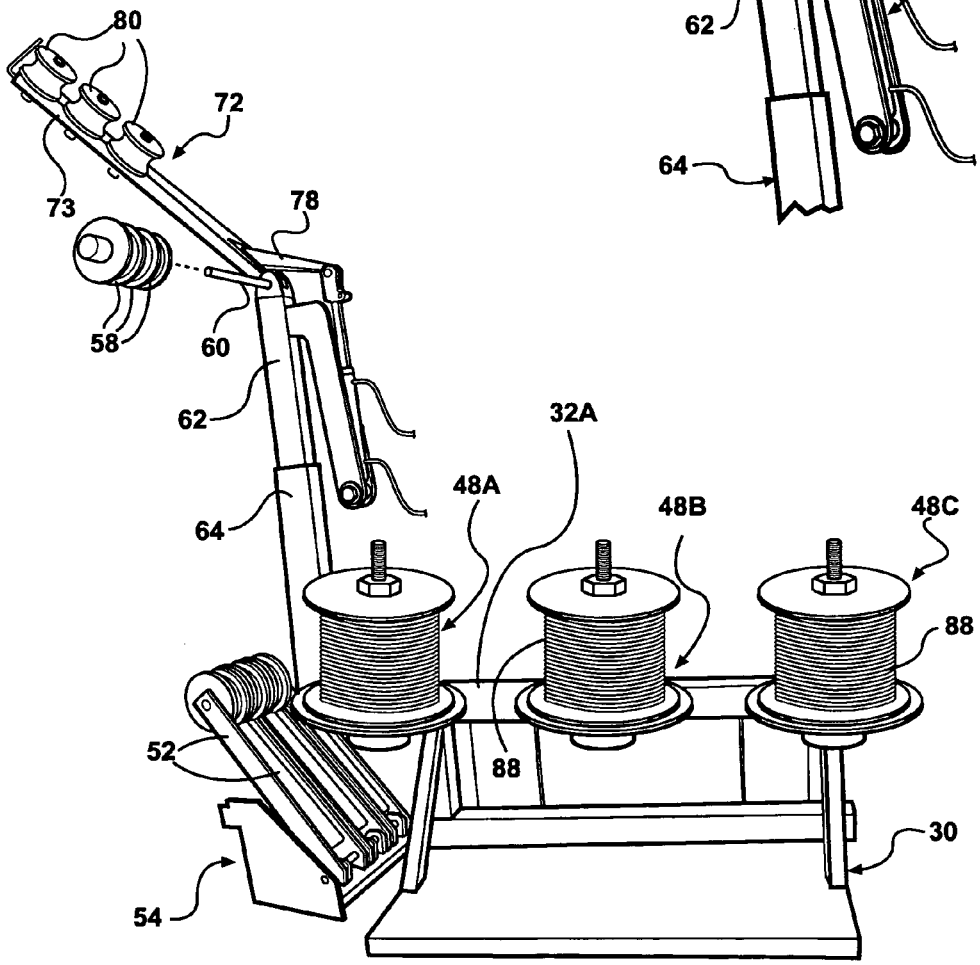
FIG. 5 is a pictorial view of the wire dispenser included in the fencing apparatus shown in FIG. 1 but with the reels of tension wire in place on two reel rotary supports and an extra guide pulley replacing one of the rotary supports.

The angled support arm 72 can be moved through a range of positions as shown in FIG. 5 by operation of the power cylinder 74 connected by a link 75 to maintain a roughly aligned orientation of the end portion 73 of the arm 72 with the barb caps 20 with changing grades traversed by a vehicle 10. This allows the barbed wire strands 46A–C to be strung and hooked more easily to the barb caps 20 as shown in FIG. 4.

Figure 6:
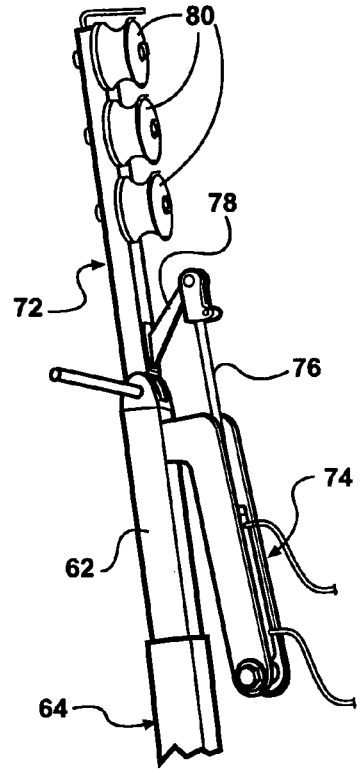
FIG. 6 is a pictorial view of a connecting link between of the pulley supporting angled swing arm on the power cylinder to allow the arm to be moved through a range of motion from a vertical position.

If the barb caps 20 are of a type which extend vertically, the arm 78 may be reconnected to the arm 72 to allow a more vertically oriented range of adjusted positions as shown in FIG. 6.

A strand retainer rod 82 is affixed alongside the most outboard of the pulleys 50 to keep the wire strands 46A–C from jumping off that pulley. The close spacing of the other pulleys 50 accomplishes the same end.

Pulling a strand of barb wire 46A, B, C of each roll causes rotation of each rotary support 40 and retarder 45 to develop a predetermined tension in the strands 46A–C which is at the level desired in the strands when strung on the barb caps 20.

Thus, the three barbed wire strands 46A–C can be strung simultaneously as shown in FIG. 4 (after the fencing fabric 84 has been installed) in a pretensioned state. An installer standing on the platform 12 can hook the strands to the bar caps 20 when the vehicle 10 slowly passes each post 14.

The independent routing of the barbed wire strands 46A–C through the three sets of three pulleys 50, 58, 80 and a respective one of three retarders 45 allows individual tensioning of each strand 46A–C even through simultaneously strung along the barb caps 20 by the vehicle motion.

Thus, fewer passes along the fence line required, and these fewer passes are quicker, so that considerable time and labor savings are realized, particularly for large sections of fencing.

Figure 9:
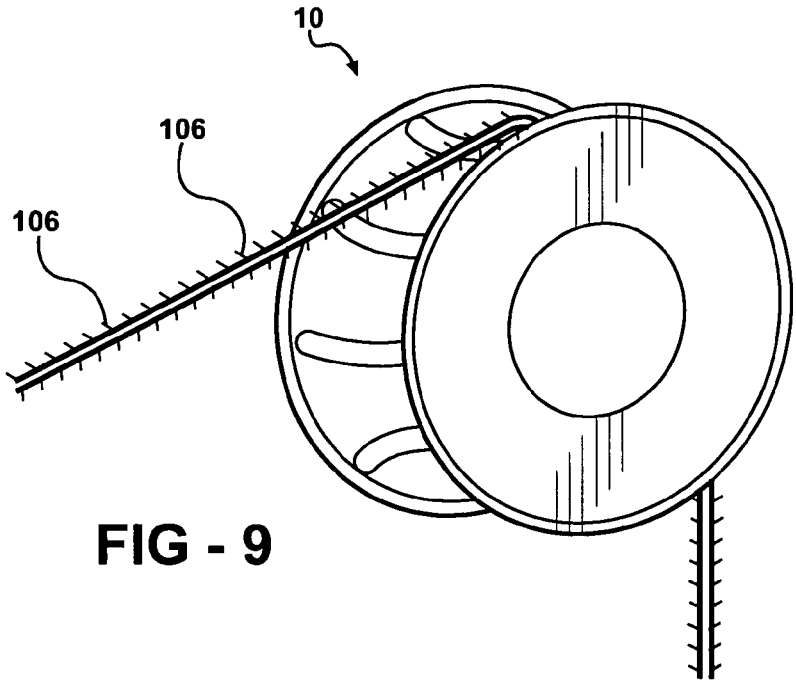
FIG. 9 is a pictorial view of an improved pulley for use with barbed wire.
Figure 10:
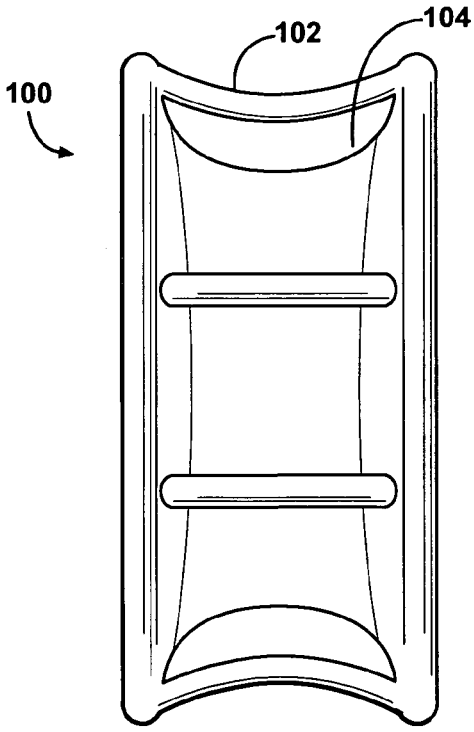
FIG. 10 is a side view of the pulley shown in FIG. 9.

FIGS. 9 and 10 show a preferred form of pulley 100 in which rods 102 are welded across the radiused groove 104. This spaces the barbs 106 above the bottom and avoids bending over the barbs 106.

It is noted that the elevated platform may be eliminated for lower fences.

What is claimed is:

1. A fencing apparatus comprising:

a powered vehicle;

a bar rack mounted on one side of the vehicle able to slidably receive thereon a series of barbed wire fence post caps having an opening formed therein receiving said bar rack to be slidably held thereof; and a wire dispenser carried on said vehicle for dispensing tension wire, said tension wire being threaded through said post cap openings together with said bar rack.

2. A fencing apparatus for simultaneously stringing multiple strands of barbed wire onto a series of barb caps installed on the top of respective fence posts extending in a series along a fence line, comprising:

a powered vehicle;

multiple rolls of barbed wire each mounted side by side on a respective substantially vertical rotary roll support carried on said vehicle, each roll support mounted to allow rotation thereof to unwind a barbed wire strand from a respective roll;

a retarder restricting rotation of each roll support to develop a predetermined tension in a strand of barbed wire pulled off each roll;

a pulley system including pulleys for each of said multiple wire strands routing individually each of said unwound wires strands so as to extend back in approximate alignment with the direction said wires are strung along said barb caps, said pulley system comprises a first set of side by side pulleys horizontally offset from said rotatory roll supports having a separate pulley for receiving a respective strand of barbed wire received from a respective roll, each strand passing off a respective pulley and extending upwardly to a second set of side by side pulleys, each strand passing around a respective separate coaxial pulley in said second set of pulleys, each strand passing off said respective pulley in said second set and extending to a respective pulley in a third set of pulleys arranged to rotate about parallel but offset axes, and thereafter extending to said barb caps.

3. The apparatus according to claim 2 wherein said third set of pulleys is mounted to a support arm with each pulley mounted at spaced locations along said arm for rotation about a separate axis.

4. The apparatus according to claim 2 wherein said second set of pulleys is mounted to an upright member, said second set of pulleys arranged coaxially thereon; and said support arm is mounted to an upper part of said upright member.

5. The apparatus according to claim 3 wherein said support arm is pivoted to said upright member to be able to be set at an adjustable angle with respect to said upright member approximately matched to said barb caps.

6. The apparatus according to claim 4 further including a power cylinder connected to said support arm and said upright member to enable said adjustable setting of the inclination of said arm.

7. The apparatus according to claim 6 wherein said upright member is mounted on one side of said powered vehicle and said support arm inclination in a side to side direction can be adjusted to compensate for changing grade traversed by said vehicle along said fence line.

8. The apparatus according to claim 7 wherein said rotary roll supports are mounted side by side on a support at the front of said vehicle for rotation about vertical axes.

9. The apparatus according to claim 8 wherein an elevated walkway platform is mounted on one side of said vehicle allowing a installer to secure said strands to successive barb caps.

10. The apparatus according to claim 9 wherein a rack for slidably receiving a series of barb caps is mounted extending along said walkway platform.

11. The apparatus according to claim 2 wherein said first set of pulleys are mounted on a pivoted mount to enable movement of said mount upon a predetermined increase in tension in said strands to allow pivoting of said mount to relieve stress to avoid breakage of said strands.

12. The apparatus according to claim 4 wherein said upright member includes telescoped parts thereof allowing a height adjustment.

13. The apparatus according to claim 3 wherein said support arm is angled from said upright member to approximately align said third set of pulleys with said second set of pulleys.

14. The apparatus according to claim 5 wherein said inclination is set to approximately match an inclination of said barb caps on said fence posts.

15. The apparatus according to claim 9 wherein said walkway platform and fencing apparatus is mounted to a front end loader on said vehicle allowing raising and lowering thereof with respect to said fence posts.

16. A method of simultaneously stringing and tensioning multiple strands of wire along caps on a series of fence posts extending along a fence line comprising:

mounting a plurality of rolls of wire on a structure on a motor vehicle for each strand to be rotatable about a substantially vertical axis so that pulling on each strand unwinds the same by rotation of the associated roll;

retarding rotation of each roll to generate a predetermined tension in each strand when said strand is unwound;

routing said strands through a first set of pulleys, having a rotary axis aligned with each other and located to one side of said rollers of wire;

mounting a second set of pulleys mounted aligned with each other on an upright member and through a third pulley set of side by side pulleys mounted on a support arm extending laterally from an upper end of said upright member at substantially the height of said post caps and routing said strands around said sets to said post caps;

advancing said rolls and sets of pulleys along said fence line to unwind said wire strands from said rolls under said predetermined tension; and fastening each strand to a respective attachment point on each post cap after said strands are pulled past each post cap.

17. The method according to claim 15 including mounting said first set of pulleys on a spring biased swing arm allowing relief if said wire strands are overstressed.

18. The method according to claim 16 further including pivoting said upper arm to incline said third set of pulley wheels to approximately match an inclination of said post caps.

19. The method according to claim 16 further including driving said motor vehicle along said fence line to unwind said wire strands from said rolls.

* * * * *